252-102 AU 165 EX
9/27/77 XR 4,051,057

United States Patent [19]

Ericson et al.

[11] 4,051,057

[45] Sept. 27, 1977

[54] SOLUTIONS FOR CLEANING SURFACES OF COPPER AND ITS ALLOYS

[76] Inventors: Harry Ericson, Grevebergsgatan 13, Vastra Frolunda, Sweden, 421 56; Carl Otto Fredriksson, Bogatan 37 B, Goteborg, Sweden, 412 72

[21] Appl. No.: 638,697

[22] Filed: Dec. 8, 1975

[30] Foreign Application Priority Data

Dec. 13, 1974 Sweden ..... 74156480

[51] Int. Cl.[2] ..... C11D 7/08; C11D 7/18; C11D 7/32

[52] U.S. Cl. ..... 252/100; 134/3; 134/41; 252/102; 252/142; 252/548; 423/272

[58] Field of Search ..... 252/85, 87, 100, 102, 252/142, 148, 79.2, 79.4, 548; 134/3, 41; 156/18, 20, 666, 903; 423/272

[56] References Cited

U.S. PATENT DOCUMENTS

| | | | |
|---|---|---|---|
| 2,318,559 | 5/1943 | Percival | 134/3 X |
| 2,428,804 | 10/1947 | Terry et al. | 252/100 |
| 2,894,905 | 7/1959 | Bernard | 252/148 X |
| 3,345,217 | 10/1967 | Wollgien et al. | 134/3 X |
| 3,537,895 | 11/1970 | Lancy | 134/3 |
| 3,556,883 | 1/1971 | Naito et al. | 252/79.4 X |
| 3,770,530 | 11/1973 | Fujimoto | 252/79.4 X |
| 3,773,577 | 11/1973 | Shibasaki et al. | 156/18 X |
| 3,809,588 | 5/1974 | Zeblisky | 156/18 |
| 3,869,401 | 3/1975 | Ernst | 423/272 X |
| 3,905,907 | 9/1975 | Shiga | 134/3 X |
| 3,948,703 | 4/1976 | Kushibe | 156/20 |

FOREIGN PATENT DOCUMENTS

| | | |
|---|---|---|
| 1,317,445 | 5/1973 | United Kingdom |

*Primary Examiner*—Harris A. Pitlick

[57] ABSTRACT

A solution for pickling copper and its alloys contains one or more mineral acids, such as sulphuric acid or phosphoric acid, in combination with hydrogen peroxide and a hydroxy acid, such as citric acid or gluconic acid, together with a nitrogen combination of the type substituted triazole and/or a tertiary amine of the general formula

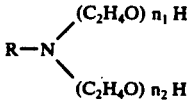

in which R is an aliphatic carbon chain containing less than 24 carbon atoms and the sum of $n_1$ and $n_2$ is less than 30.

8 Claims, No Drawings

SOLUTIONS FOR CLEANING SURFACES OF COPPER AND ITS ALLOYS

The present invention relates to a pickling solution for removing oxides and cleaning surfaces of copper and its alloys, prior to a succeeding treatment, for instance soldering, chemical or electrolytic polishing, lacquering and electroplating.

Generally, the usual mineral acids can be used to dissolve copper oxide. However, normally a stronger pickling action is required and, therefore, oxidating acids are used, such as nitric acid in high concentration, chromic acid or sulphuric acid in combination with chromic acid, bichromate-sulphuric acid, ferric chloride solution and mineral acids in combination with hydrogen peroxide.

There are disadvantages connected to these methods. For instance, when using nitric acid, nitrous gases are generated and, when using baths containing chromate, problems arise in treatment of the waste water. Another disadvantage is that these acids make a relatively strong attack on the base metal with risks for pittings. For several reasons, the most recommendable method involves combinations with hydrogen peroxide. However, when free metals are present in the pickling bath, the stability of the hydrogen peroxide will be low.

When pickling in general, and when pickling with hydrogen peroxide in particular, there are often, problems, such as non-uniform pickling results, presenting themselves as variations in colour, red-pickling, and sometimes also pittings. These disadvantages are probably caused by variations of the surface structure of the alloy, arising in connection with its casting or such machining of it as milling, drawing, soldering and turning.

We have found that the stability of the hydrogen peroxide in pickling baths containing organic complexing agents can be improved further by adding a substituted triazole, preferably benzotriazole and/or a tertiary fatty amine of the general formula:

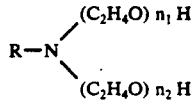

in which R is an aliphatic carbon chain containing less than 24 carbon atoms and the sum of $n_1$ and $n_2$ is less than 30.

When using the, nitrogen combination the result has been a levelling effect.

According to the invention, the solution contains one or more mineral acids, such as sulphuric acid, or phosphoric acid in combination with hydrogen peroxide, and a hydroxy acid, such as citric acid or gluconic acid, together with a nitrogen combination of the type substituted triazole and/or a tertiary amine of the general formula:

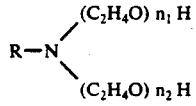

in which R is an aliphatic carbon chain containing less than 24 carbon atoms and the sum of $n_1$ and $n_2$ is less than 30.

The invention provides a pickling process which gives considerable advantages, with respect to the milieu. The solution is characterized through an extraordinary stability, rapid dissolution of oxides with an inappreciable corrosion on the base metal and the possiblity of regeneration through electrolytic deposition and recovery of dissolved metals.

The invention will be more easily understood through the following Examples:

EXAMPLE 1

| | |
|---|---|
| Sulphuric acid, conc. | 75 g/l |
| Citric acid | 35 g/l |
| Hydrogen peroxide 35 % | 15 g/l |

Tenside with the general formula

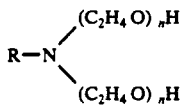

0,5 g/l in which

R is an aliphatic carbon chain with 18 carbon atoms and $n = 12$

| | |
|---|---|
| Operating conditions: | |
| Temperature | 25 - 35° C |
| Treatment time | 2 - 10 minutes |

EXAMPLE 2

| | |
|---|---|
| Sulphuric acid, conc. | 50 g/l |
| Citric acid | 25 g/l |
| Hydrogen acid 35 % | 25 g/l |
| Tenside according to Example 1 | 0,5 g/l |
| Benzotriazole | 0,25 g/l |
| Operating conditions: | |
| Temperature | 30° C |
| Treatment time | 2 minutes |

EXAMPLE 3

| | |
|---|---|
| Sulphuric acid | 80 g/l |
| Citric acid | 30 g/l |
| Hydrogen peroxide 35 % | 25 g/l |
| Benzotriazole | 0,25 g/l |

EXAMPLE 4

| | |
|---|---|
| Sulphuric acid | 20 g/l |
| Citric acid | 30 g/l |
| Hydrogen peroxide | 14 g/l |
| Benzotriazole | 0,25 g/l |

Operating temperature for Examples 3 and 4 was 25° C.

Tests were made to determine the material removing ability and the following results were obtained:

| | |
|---|---|
| Example 2 | 30 g/m²h |

-continued

| | |
|---|---|
| Example 3 | 200 g/m²h |
| Example 4 | 132 g/m²h |

Examples 3 and 4 show that almost direct proportionality exists between the hydrogen peroxide concentration and the dissolution speed under the conditions given.

To get an opinion of the stability of the hydrogen peroxide the following test series was made:

| | |
|---|---|
| Solution 1 | |
| Sulphuric acid | 45 g/l |
| Citric acid | 25 g/l |
| Hydrogen peroxide 100 % | 20 g/l initial conc. |
| Solution 2 | |
| Sulphuric acid | 45 g/l |
| Citric acid | 25 g/l |
| Benzotriazole | 0,1 g/l |
| Hydrogen peroxide | 20 g/l |
| Solution 3 | |
| Sulphuric acid | 45 g/l |
| Citric acid | 25 g/l |
| Tenside according to Example 1 | 0,5 g/l |
| Hydrogen peroxide | 20 g/l |
| Solution 4 | |
| Sulphuric acid | 45 g/l |
| Citric acid | 25 g/l |
| BTA | 0,1 g/l |
| Tenside according to Example 1 | 0,5 g/l |
| Hydrogen peroxide | 20 g/l |

All tests contain initially 5 g/l $Cu^{2+}$-ions and 1 dm²/l copper metal.

The different pickling solutions were acting on the copper metal continuously during 96 hours.

Tests were taken after 4, 24 and 96 hours and the hydrogen peroxide strength was determined through titration with potassium permanganate in an ambient sulphurous acid.

The results are reported in the following table:

| Solution | Hours 4 | Hours 24 | Hours 96 |
|---|---|---|---|
| 1 | 13,8 | 4,6 | 0,5 |
| 2 | 16,0 | 7,8 | 2,6 |
| 3 | 16,7 | 13,9 | 9,2 |
| 4 | 17,1 | 10,2 | 4,3 |

The values stated in the table refer to g/l 100% hydrogen peroxide.

Considering the stability of the hydrogen peroxide, the composition according to Solution 3 is optimal.

Considering both the stability and the levelling effect, the composition according to Solution 4 is preferred.

We claim:

1. A solution for pickling copper and its alloys which contains 5 - 125 g/l of one or more mineral acids selected from the group consisting of sulphuric acid and phosphoric acid, 2 - 50 g/l hydrogen peroxide, 5 - 100 g/l hydroxy acid selected from the group consisting of citric acid and gluconic acid, and 0.01 - 5 g/l of one or more of the group consisting of benzotriazole and a tertiary amine of the general formula

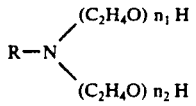

in which R is an aliphatic carbon chain containing less than 24 carbon atoms and the sum of $n_1$ and $n_2$ is less than 30.

2. A solution according to claim 1 in which the hydroxy acid is a citric acid in concentrations of 5 -100 gl.

3. A solution according to claim 1 which contains 0.01 - 5 g/l aliphatic fatty amine of the formula

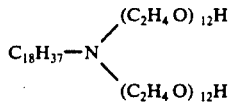

4. A solution according to claim 1 which contains 0.01 -5 g/l of benzotriazole.

5. A solution according to claim 1 which contains 5 - 125 g/l sulphuric acid.

6. A process for pickling a surface of copper and its alloys by providing a solution containing 5 - 125 g/l of one or more of the mineral acids selected from the group consisting of sulphuric acid and phosphoric acid, 2 - 50 g/l hydrogen peroxide, 5 - 100 g/l hydroxy acid selected from the group consisting of citric acid and gluconic acid, and 0.01 - 5 g/l of one or more of the group consisting of benzotriazole and a tertiary amine of the general formula

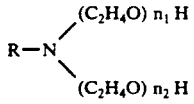

in which R is an aliphatic carbon chain containing less than 24 carbon atoms and the sum of $n_1$ and $n_2$ is less than 30, and introducing the surface to be pickled into the solution.

7. The process of claim 6 wherein the surface to be pickled is maintained for 2 to 10 minutes at a temperature of 25° to 35° C.

8. The process of clain 6 wherein the tertiary amine is present in concentrations of 0.01 - 5 g/l aliphatic fatty amine of the formula

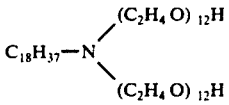

* * * * *